US008526845B2

(12) United States Patent
Nonaka et al.

(10) Patent No.: US 8,526,845 B2
(45) Date of Patent: Sep. 3, 2013

(54) CLEANING MEMBER FOR IMAGE FORMING APPARATUS INCLUDING A CORE AND AN ELASTIC LAYER, CHARGING DEVICE, UNIT FOR IMAGE FORMING APPARATUS, PROCESS CARTRIDGE, AND IMAGE FORMING APPARATUS

(75) Inventors: Akihiro Nonaka, Kanagawa (JP); Takeshi Kawai, Kanagawa (JP); Makoto Takemoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 354 days.

(21) Appl. No.: 13/017,638

(22) Filed: Jan. 31, 2011

(65) Prior Publication Data

US 2011/0318047 A1 Dec. 29, 2011

(30) Foreign Application Priority Data

Jun. 28, 2010 (JP) ..... 2010-146761

(51) Int. Cl.
*G03G 15/02* (2006.01)

(52) U.S. Cl.
USPC ..... 399/100

(58) Field of Classification Search
USPC ..... 399/100, 101, 347, 357
See application file for complete search history.

(56) References Cited

U.S. PATENT DOCUMENTS

| | | | | |
|---|---|---|---|---|
| 4,870,465 | A * | 9/1989 | Lindblad et al. | 399/347 |
| 8,290,391 | B2 * | 10/2012 | Kawahara | 399/100 |
| 8,320,790 | B2 * | 11/2012 | Yamaguchi | 399/100 |
| 8,391,745 | B2 * | 3/2013 | Nishikawa et al. | 399/100 |

FOREIGN PATENT DOCUMENTS

| | | |
|---|---|---|
| JP | A-2-272594 | 11/1990 |
| JP | A-7-129055 | 5/1995 |
| JP | A-7-219313 | 8/1995 |
| JP | A-2001-209238 | 8/2001 |

* cited by examiner

*Primary Examiner* — William J Royer
(74) *Attorney, Agent, or Firm* — Oliff & Berridge, PLC

(57) ABSTRACT

A cleaning member for an image forming apparatus includes a core and an elastic layer helically put on an outer peripheral surface of the core and including a first elastic layer and a second elastic layer, the first elastic layer being an outermost layer and the second elastic layer being located closer to the core than the first elastic layer and having a compression set smaller than that of the first elastic layer.

19 Claims, 8 Drawing Sheets

CLEANING MEMBER FOR IMAGE FORMING APPARATUS INCLUDING A CORE AND AN ELASTIC LAYER, CHARGING DEVICE, UNIT FOR IMAGE FORMING APPARATUS, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2010-146761 filed Jun. 28, 2010.

BACKGROUND (i) Technical Field

The present invention relates to a cleaning member for an image forming apparatus, a charging device, a unit for an image forming apparatus, a process cartridge, and an image forming apparatus.

(ii) Related Art

According to an electrophotographic image forming apparatus, a surface of an image-carrying member including a photoconductor or the like is charged with a charging device to create charges and an electrostatic latent image is formed by, for example, a laser beam obtained by modulating an image signal. The electrostatic latent image is developed with charged toner to form a visible toner image. The toner image is electrostatically transferred onto a transfer-receiving member such as a recording sheet either directly or via an intermediate transfer member and fixed onto a transfer-receiving member to obtain an image.

SUMMARY

According to an aspect of the invention, there is provided a cleaning member for an image forming apparatus, the cleaning member including a core and an elastic layer. The elastic layer is helically put on an outer peripheral surface of the core and includes a first elastic layer and a second elastic layer. The first elastic layer is the outermost layer, and the second elastic layer is located closer to the core than the first elastic layer and has a compression set smaller than that of the first elastic layer.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described. The components that have the same functions and effects are represented by the same reference symbols throughout the drawings and the descriptions therefore may be omitted to avoid redundancy.

(Cleaning Member)

Figure 1:
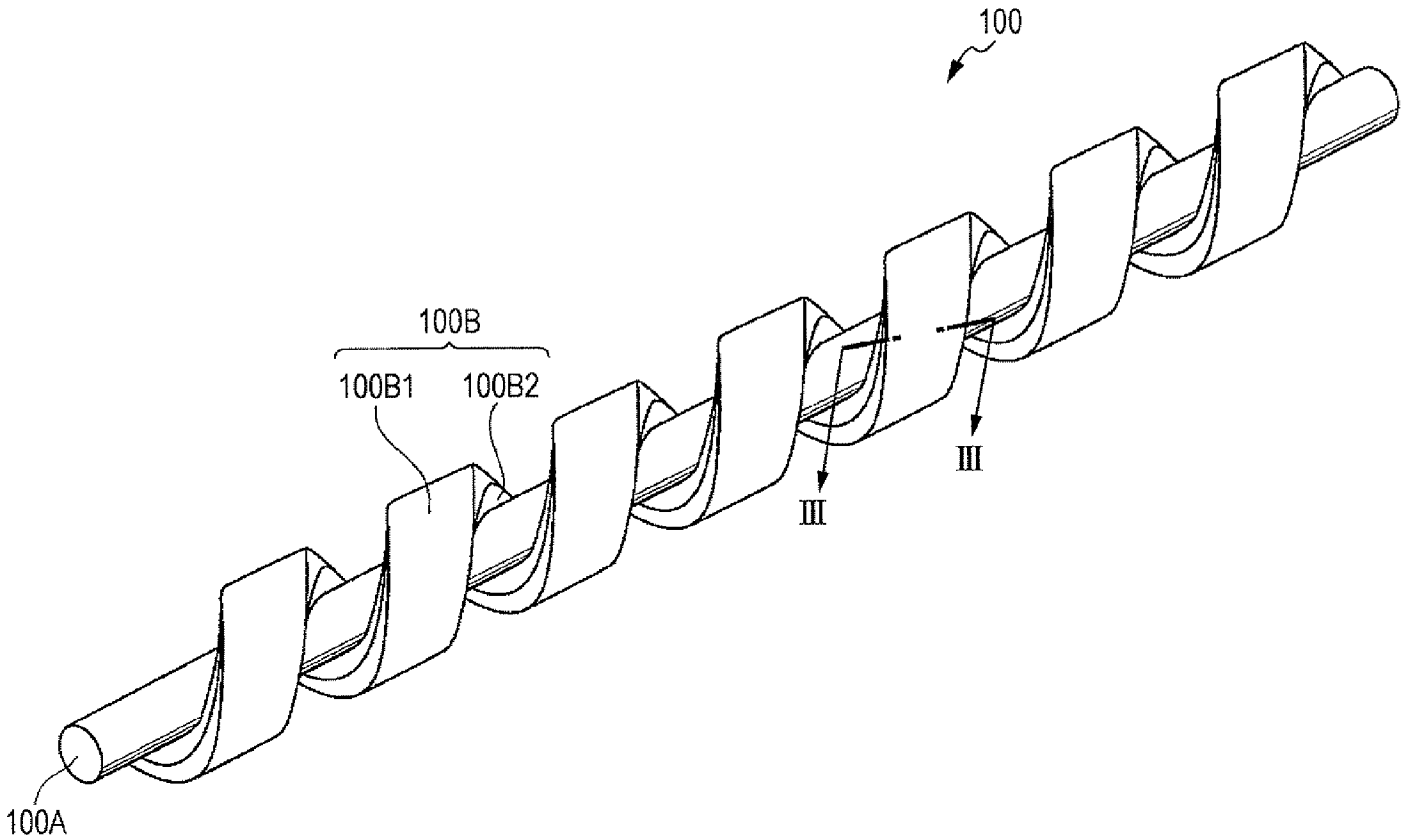
FIG. 1 is a schematic perspective view showing a cleaning member for an image forming apparatus according to an exemplary embodiment.
Figure 2:
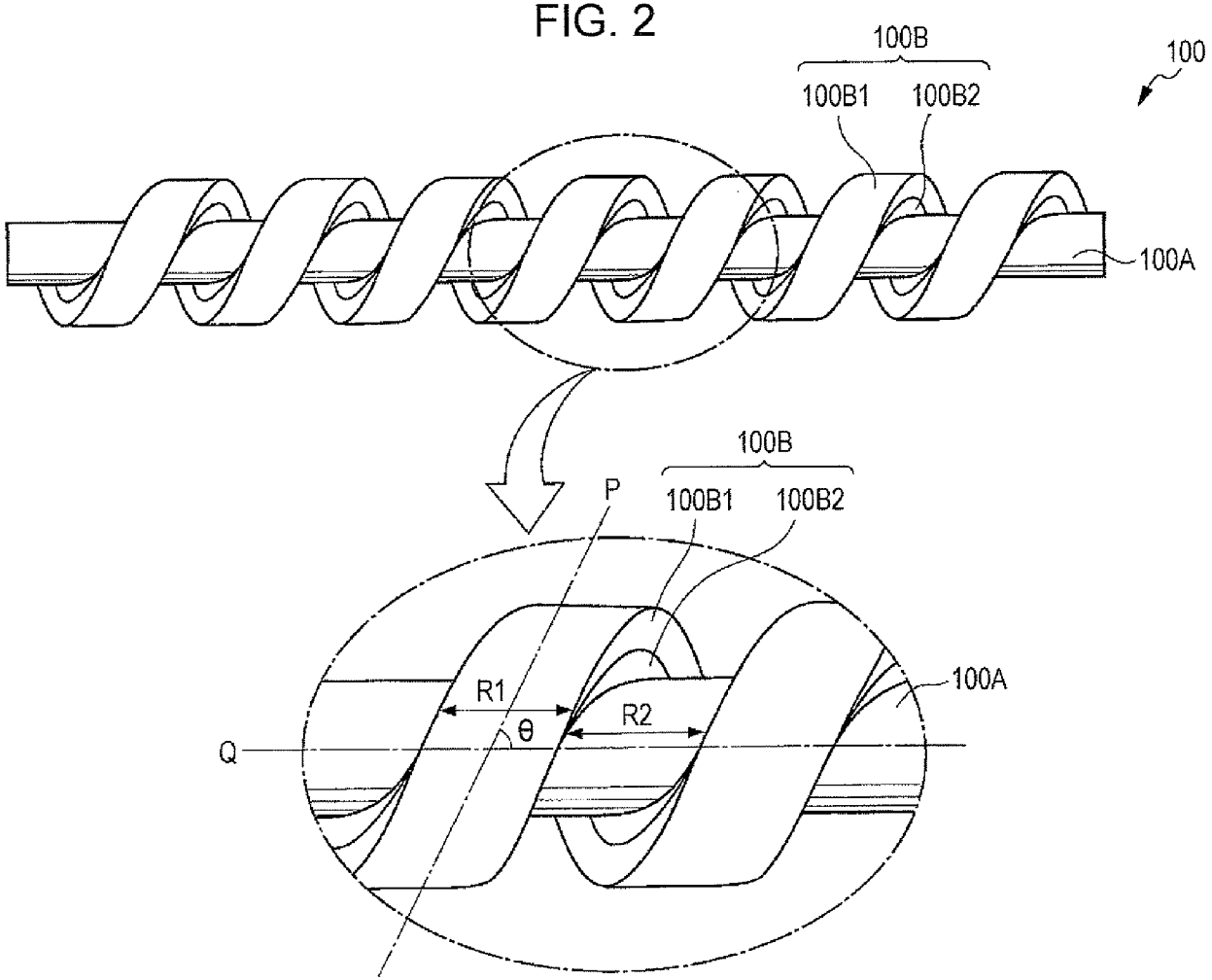
FIG. 2 is a schematic perspective view of the cleaning member for an image forming apparatus according to the exemplary embodiment.
Figure 3:
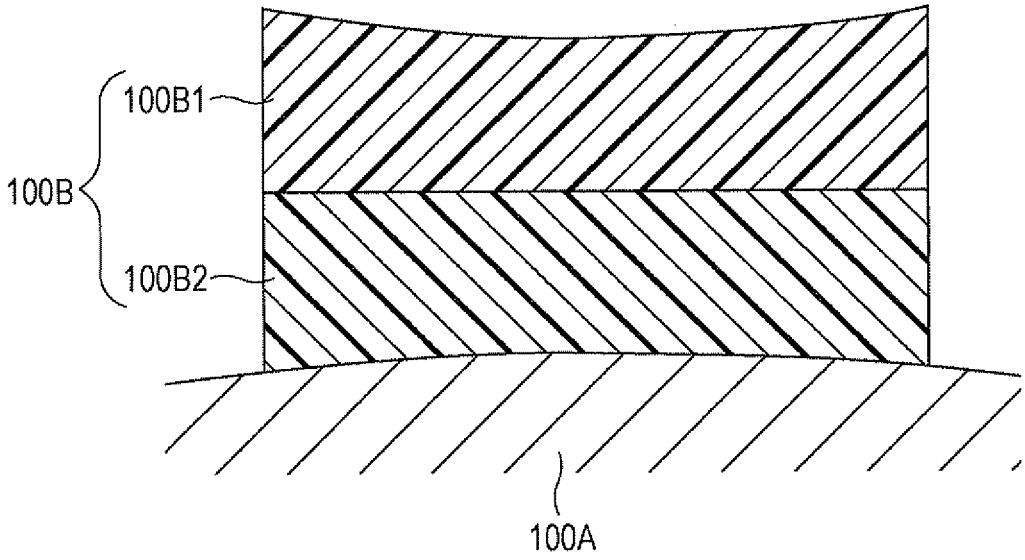
FIG. 3 is an enlarged cross-sectional view showing the thickness of an elastic layer of the cleaning member for an image forming apparatus according to the exemplary embodiment.

FIG. 1 is a schematic perspective view showing a cleaning member for an image forming apparatus according to an exemplary embodiment. FIG. 2 is a schematic plan view of the cleaning member. FIG. 3 is an enlarged cross-sectional view showing the thickness of an elastic layer of the cleaning member and is taken along line in FIG. 1, i.e., in a direction orthogonal to the helical direction of the elastic layer.

As shown in FIGS. 1 to 3, a cleaning member 100 of an image forming apparatus (simply referred to as "cleaning member 100" hereinafter) according to this exemplary embodiment is a roll-shaped member that includes a core 100A and an elastic layer 100B. The elastic layer 100B is helically put on a surface of the core 100A. In particular, the elastic layer 100B is helically wound around the core 100A as a helical axis from one end to the other end of the core 100A at particular intervals.

The elastic layer 100B includes a first elastic layer 100B1 that forms the outermost layer and a second elastic layer 100B2 on the core 100A-side of the first elastic layer 100B1. In other words, the elastic layer 100B includes the second elastic layer 100B2 disposed on the outer peripheral surface of the core 100A, and the first elastic layer 100B1 is layered on the second elastic layer 100B2.

The first elastic layer 100B1 has a compression set smaller than that of the second elastic layer 100B2. In other words, the second elastic layer 100B2 has a compression set larger than that of the first elastic layer 100B1.

Since the elastic layer 100B of the cleaning member 100 contacts a member to be cleaned while being pressurized against the member to be cleaned, permanent set may occur when the cleaning member 100 is stored in such a state.

According to the cleaning member 100 of this exemplary embodiment, since the elastic layer 100B includes the second elastic layer 100B2 having a smaller compression set than the first elastic layer 100B1 is disposed below the outermost first elastic layer 100B1, the permanent set of the outermost first elastic layer 100B1 is moderated by the second elastic layer 100B2.

Thus, according to the cleaning member 100 of the exemplary embodiment, deformation of the elastic layer 100B after storage may be suppressed.

Although the cleaning member 100 of this exemplary embodiment includes an elastic layer 100B having a two-layer structure including a first elastic layer 100B1 and a second elastic layer 100B2 (in other words, the second elastic layer 100B2 has a single-layer structure), the second elastic layer 100B2 may have a multilayer structure including two or more layers. As long as the layers constituting the multilayer second elastic layer 100B2 have a compression set larger than that of the outermost first elastic layer 100B1, deformation of the elastic layer 100B after storage is still suppressed due to the same reason.

A charging device, process cartridge, and image-forming apparatus equipped with the cleaning member 100 of this exemplary embodiment will have less image defects (such as banding) caused by the deformation of the elastic layer 100B after storage since the nonuniform contact between the cleaning member 100 and the member to be cleaned is suppressed.

The individual components will now be described.

The core 100A is described first.

Examples of the material for the core 100A include metals (e.g., free-cutting steel and stainless steel) and resins (e.g., polyacetal (POM) resin). The material and the surface treatment method may be selected according to need.

When the core 100A is composed of a metal, the core 100A may be plated. When the core 100A is composed of a material having no electrical conductivity, such as a resin, the material may be processed by a typical treatment such as plating to impart electrical conductivity or may be directly used as is.

The elastic layer 100B is described next.

The elastic layer 100B includes a first elastic layer 100B1 that forms the outermost layer and a second elastic layer 100B2 on the core 100A-side of the first elastic layer 100B1.

The compression set of the first elastic layer 100B1 is, for example, 5% to 15%, preferably 5% to 12%, and more preferably 5% to 10%. The compression set of the second elastic layer 100B2 is, for example, less than 5%, preferably less than 3%, and more preferably less than 1%.

When the compression sets of the first elastic layer 100B1 and the second elastic layer 100B2 are both within the above-described ranges, the permanent deformation of the first elastic layer 100B1 may be easily moderated by the second elastic layer 100B2 and deformation of the elastic layer 100B after storage may be easily suppressed.

The compression set of the elastic layer 100B (first elastic layer 100B1 and second elastic layer 100B2) is adjusted by, for example, choosing a material and a foaming agent, adjusting the cell size, and the like.

The compression set is measured by the following method.

A measurement sample 1 mm×5 mm×5 mm in size is cut out from a desired position of the elastic layer 100B of the cleaning member 100. The sample is deformed to a thickness 50% of the original thickness in a thermostat oven at 70° C. by using a compression plate large enough to cover a front surface of the sample, and left standing in such a state for 22 hours. The compression plate is then removed and the thickness of the sample is measured within 1 minute from the removal using a caliper. The compression set is calculated by the following equation where $I_0$ is the original thickness of the sample and $I_1$ is the thickness after the test:

$$\text{Compression set (\%)} = (I_0 - I_1)/I_0 \times 100 \qquad \text{Equation}$$

Examples of the material for the elastic layer 100B (first elastic layer 100B1 and second elastic layer 100B2) include foaming resins such as polyurethane, polyethylene, polyamide, and polypropylene and rubber materials such as silicone rubber, fluorine rubber, urethane rubber, ethylene propylene diene rubber (EPDM), nitrile butadiene rubber (NBR), chloroprene rubber (CR), chlorinated polyisoprene, isoprene, acrylonitrile-butadiene rubber, styrene-butadiene rubber, hydrogenated polybutadiene, and butyl rubber, and any blends of two or more of these materials. Assistant agents such as such as a foaming aid, a foam stabilizer, a catalyst, a curing agent, a plasticizer, or a vulcanization accelerator may be added to these materials.

The material for the elastic layer 100B may be a material having voids, in other words, a foamed material. In particular, polyurethane foam highly resistant to stretching may be used in order not to scratch the surface of the member to be cleaned and in order to prevent tearing and breaking over a long term.

Examples of the polyurethane include reaction products between a polyol (e.g., polyester polyol, polyether polyester, or acryl polyol) and an isocyanate (such as 2,4-tolylene diisocyanate, 2,6-tolylene diisocyanate, 4,4-diphenylmethane diisocyanate, tolidine diisocyanate, or 1,6-hexamethylene diisocyanate). The polyurethane may contain a chain extender such as 1,4-butanediol or trimethylol propane. Foaming of polyurethane is typically conducted by using a foaming agent such as water or an azo compound (e.g., azodicarbonamide, azobisisobutyronitrile, and the like). An assistant agent such as a foaming aid, a foam stabilizer, or a catalyst may be added to the polyurethane foam if needed.

An ether-based polyurethane foam is particularly preferred. This is because ester-based polyurethane foam has a tendency to deteriorate under humidity and heat. A silicone oil foam stabilizer is typically used for the ether-based polyurethane. However, image defects caused by migration of silicone oil to the member to be cleaned (e.g., charging roller) may occur during storage (in particular, long-term storage at high temperature and high humidity). Accordingly, a foam stabilizer other than silicone oil is used to prevent image defects caused by the elastic layer 100B.

Examples of the foam stabilizer other than silicone oil include Si-free organic surfactants (e.g., anionic surfactants such as dodecylbenzenesulfonic acid and sodium lauryl sulfate). A method disclosed in Japanese Unexamined patent application Publication No. 2005-301000 that does not use a silicone foam stabilizer may also be employed.

Whether a foam stabilizer other than silicone oil is used in the ether-based polyurethane foam is determined by examining whether Si is contained through componential analysis.

An exemplary combination of the materials for the first elastic layer 100B1 and the second elastic layer 100B2 of the elastic layer 100B is a combination of a first elastic layer 100B1 composed of an ether-based polyurethane foam using a foam stabilizer other than silicone oil and a second elastic layer 100B2 composed of an ether-based polyurethane foam.

This is because although an ether-based polyurethane foam using a foam stabilizer other than silicone oil has a small cell size and a tendency to exhibit a large compression set, contamination of the member to be cleaned (e.g., charging roller) caused by a foam stabilizer (silicone oil) during storage (in particular, long-term storage at high temperature and high humidity) is suppressed. Thus, the ether-based polyurethane foam using a foam stabilizer other than silicone oil is suitable as the material for the first elastic layer 100B1.

The material for the second elastic layer 100B2 may be any material having a compression set smaller than that of the first elastic layer 100B1. An ether-based polyurethane foam resistant to humidity and heat may be used. In particular, an ether-based polyurethane foam using silicone oil as a foam stabilizer has a tendency to exhibit a small compression set and thus is suitable for the material for the second elastic layer 100B2.

The thickness (thickness in a central portion in the width direction) of the first elastic layer 100B1 in the elastic layer 100B is preferably 0.5 mm to 1.5 mm, more preferably 0.7 mm to 1.3 mm, and most preferably 0.8 mm to 1.2 mm.

The thickness (thickness in a central portion in the width direction) of the second elastic layer 100B2 is preferably 0.5 mm to 1.5 mm, more preferably 0.7 mm to 1.3 mm, and most preferably 0.8 mm to 1.2 mm.

The thickness of the elastic layer 100B is measured as follows, for example.

The cleaning member is scanned with a laser analyzer (Laser Scan Micrometer, model LSM 6200 produced by Mitsutoyo Corporation) in a longitudinal direction (axis direction) of the cleaning member at a traverse speed of 1 mm/s while having the circumferential direction of the cleaning member fixed so as to determine the profile of the elastic layer thickness. Subsequently, the same measurement is conducted by shifting the position of the scanning in the circumferential direction (measurement is conducted at three positions 120° apart from each other). The thickness of the elastic layer 100B is calculated on the basis of this profile.

The elastic layer 100B is helically arranged. In particular, the helical angle θ is 10° to 65° or about 10° to about 65° and preferably 20° to 50°. The helical width R1 is 3 mm to 25 mm and preferably 3 mm to 10 mm. The helical pitch R2 is 3 mm to 25 mm and preferably 15 mm to 22 mm.

The coverage by the elastic layer 100B determined by (helical width R1 of elastic layer 100B/[helical width R1 of elastic layer 100B+helical pitch R2 of elastic layer 100B (R1+R2)]) is 20% to 70% or about 20% to about 70% and preferably 25% to 55%.

When the coverage is beyond this range, the length of time the elastic layer 100B comes into contact with the member to be cleaned is increased and deposits on the surface of the cleaning member tend to re-contaminate the member to be cleaned. In contrast, when the coverage is below this range, the thickness of the elastic layer 100B is not easily stabilized and the cleaning performance may be deteriorated.

The helical angle θ is the angle (acute angle) between the longitudinal direction P (helical direction) of the elastic layer 100B and the axis direction Q (core axis direction) of the cleaning member 100.

The helical width R1 is the length of the elastic layer 100B in the axis direction Q (core axis direction) of the cleaning member 100.

The helical pitch R2 is the length between adjacent parts of the elastic layer 100B in the axis direction Q (core axis direction) of the cleaning member 100.

The elastic layer 100B refers to a layer composed of a material that returns to its original shape after being deformed by application of external force of 100 Pa.

Next, a method for manufacturing the cleaning member 100 according to the exemplary embodiment is described.

Figure 4A:
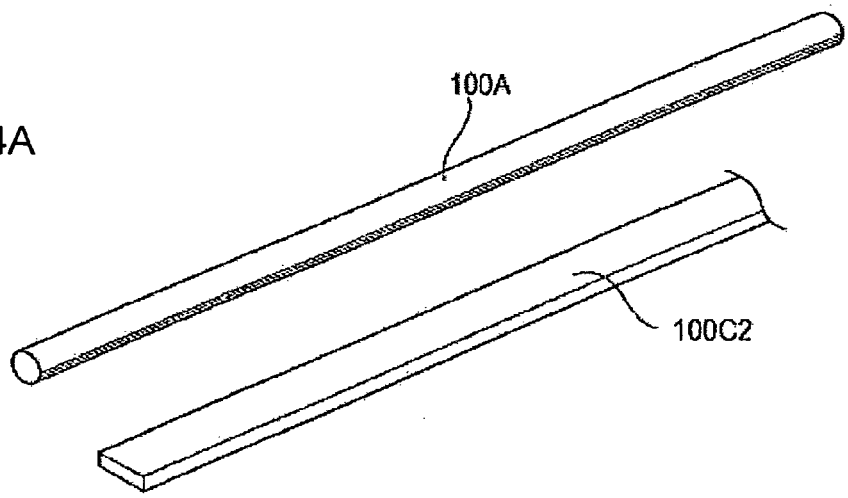
FIGS. 4A to 4C are diagrams showing examples of steps of a method for manufacturing the cleaning member for an image forming apparatus according to the exemplary embodiment.
Figure 4B:
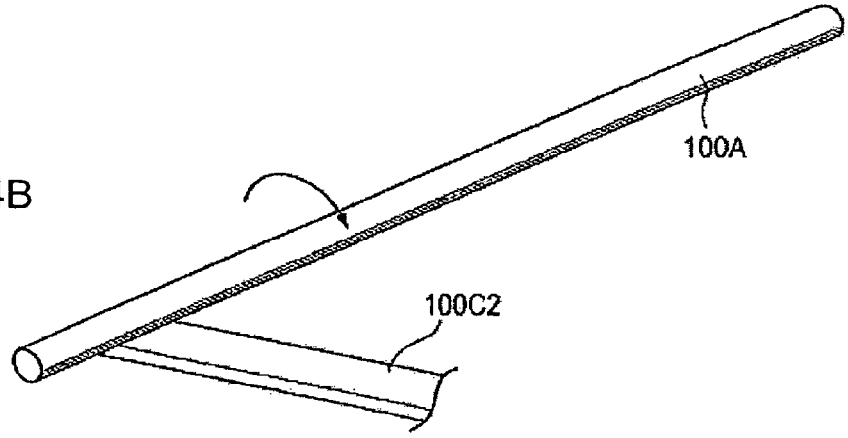
Figure 4C:
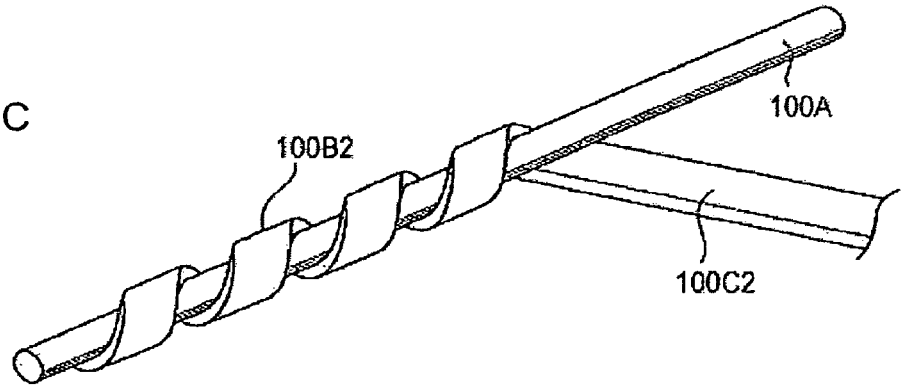

FIGS. 4A to 4C are diagrams showing examples of steps of a method for manufacturing the cleaning member 100 according to the exemplary embodiment.

Examples of the method for manufacturing the cleaning member 100 according to the exemplary embodiment are as follows.

1) A method for manufacturing a cleaning member, including preparing a rectangular prism-shaped elastic layer component (polyurethane foam or the like) for forming the second elastic layer 100B2; forming a hole for inserting the core 100A in the elastic layer component with a drill or the like; inserting into the hole the core 100A having a peripheral surface to which an adhesive is applied; and subjecting the elastic layer component to cutting work to form the second elastic layer 100B2; and preparing a rectangular prism-shaped elastic layer component (polyurethane foam or the like) for forming the first elastic layer 100B1; forming a hole for inserting the core 100A, which has the second elastic layer 100B2 formed thereon, in the elastic layer component with a drill or the like; inserting into the hole the core 100A having the second elastic layer 100B2 having a peripheral surface to which an adhesive is applied; and subjecting the elastic layer component to cutting work to form the first elastic layer 100B1.

2) A method for manufacturing a cleaning member, including preparing, by using a die, a cylindrical elastic layer component (polyurethane foam or the like) for forming the second elastic layer 100B2; forming a hole for inserting the core 100A in the elastic layer component with a drill or the like; inserting into the hole the core 100A having a peripheral surface to which an adhesive is applied to form the second elastic layer 100B2; and preparing, by using a die, a cylindrical elastic layer component (polyurethane foam or the like) for forming the first elastic layer 100B1; forming a hole for inserting the core 100A, which has the second elastic layer 100B2 formed thereon, in the elastic layer component with a drill or the like; inserting into the hole the core 100A having the second elastic layer 100B2 having a peripheral surface to which an adhesive is applied to form the first elastic layer 100B1.

3) A method for manufacturing a cleaning member, including preparing a sheet-shaped elastic layer component (polyurethane foam sheet or the like) for forming the second elastic layer 100B2, attaching a double-sided adhesive tape to the elastic layer component, blanking out a strip-shaped component (referred to as "strip" hereinafter) from the elastic layer component; winding the strip around the core 100A to form the second elastic layer 100B2; and preparing a sheet-shaped elastic layer component (polyurethane foam sheet or the like) for forming the first elastic layer 100B1, attaching a double-sided adhesive tape to the elastic layer component, blanking out a strip from the elastic layer component; and winding the strip around the second elastic layer 100B2 on the core 100A to form the first elastic layer 100B1.

Alternatively, a strip may be obtained from an elastic layer component (polyurethane foam sheet or the like) having a two-layer structure including the first elastic layer 100B1 and the second elastic layer 100B2, and the strip may be wound around the core 100A to obtain a cleaning member.

Among these methods, a method of obtaining a cleaning member 100 by winding a strip around a core is simple.

This method will now be described in detail. First, as shown in FIG. 4A, a sheet-shaped elastic layer component (polyurethane foam sheet or the like) for forming a second elastic layer 100B2 and processed to a target thickness is prepared. A double-sided adhesive tape (not shown) is attached on one surface of the elastic layer component. The elastic layer component is blanked out using a blanking die to obtain a strip 100C2 (strip with a double-sided adhesive tape) having desired width and length for forming the second elastic layer 100B2. Meanwhile, the core 100A is prepared.

Next, as shown in FIG. 4B, the strip 100C2 for forming the second elastic layer 100B2 is placed with the surface on which the double-sided adhesive tape is attached facing upward. One end of the releasing paper of the double-sided adhesive tape is detached and one end of the core 100A is placed on the portion of the double-sided adhesive tape from which the releasing paper is detached.

Then, as shown in FIG. 4C, while detaching the releasing paper of the double-sided adhesive tape, the core 100A is rotated at a target speed to helically wind the strip 100C2 around the peripheral surface of the core 100A to obtain a cleaning member 100 including a core 100A and a second elastic layer 100B2 helically arranged on the peripheral surface of the core 100A.

Figure 5A:
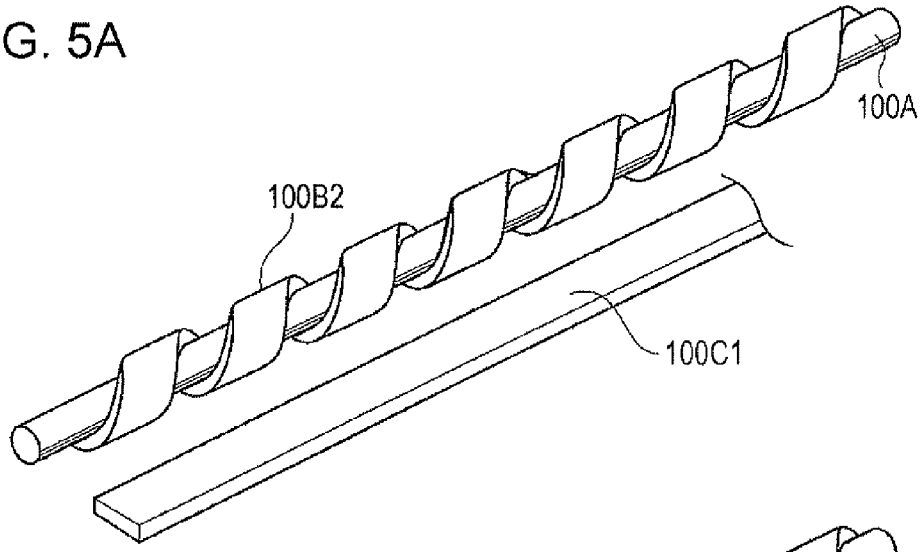
FIGS. 5A to 5C are diagrams showing examples of steps of a method for manufacturing the cleaning member for an image forming apparatus according to the exemplary embodiment.

Referring now to FIG. 5A, a sheet-shaped elastic layer component (polyurethane foam sheet or the like) for forming a first elastic layer 100B1 and being sliced to a target thickness is prepared. A double-sided adhesive tape (not shown) is attached on one surface of the sheet-shaped elastic layer component. The elastic layer component is blanked out using a blanking die to obtain a strip 100C1 (strip with a double-sided adhesive tape) having desired width and length for forming the first elastic layer 100B1.

Figure 5B:
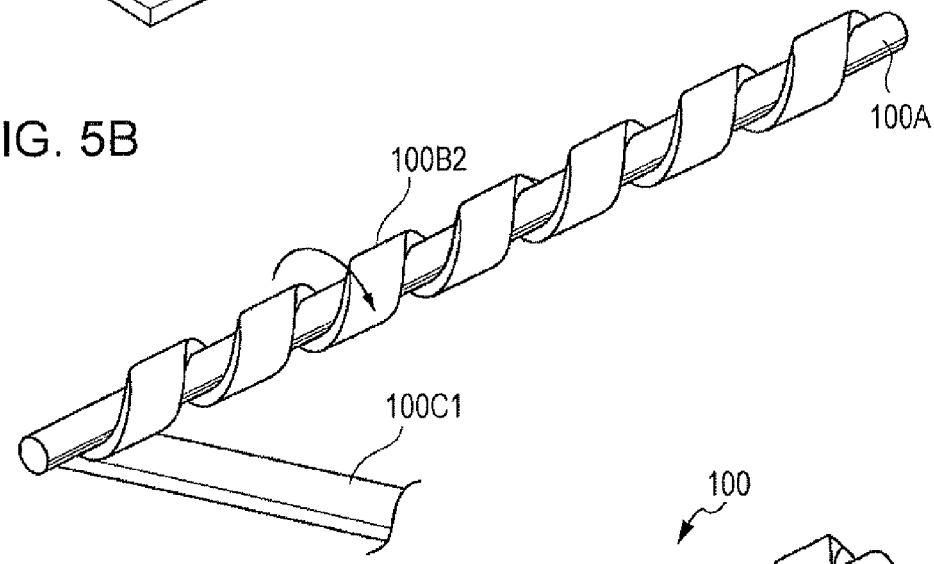

Next, as shown in FIG. 5B, the strip 100C1 for forming the first elastic layer 100B1 is placed with the surface on which the double-sided adhesive tape is attached facing upward. One end of the releasing paper of the double-sided adhesive tape is detached and one end of the second elastic layer 100B2 on the core 100A is placed on the portion of the double-sided adhesive tape from which the releasing paper is detached.

Figure 5C:
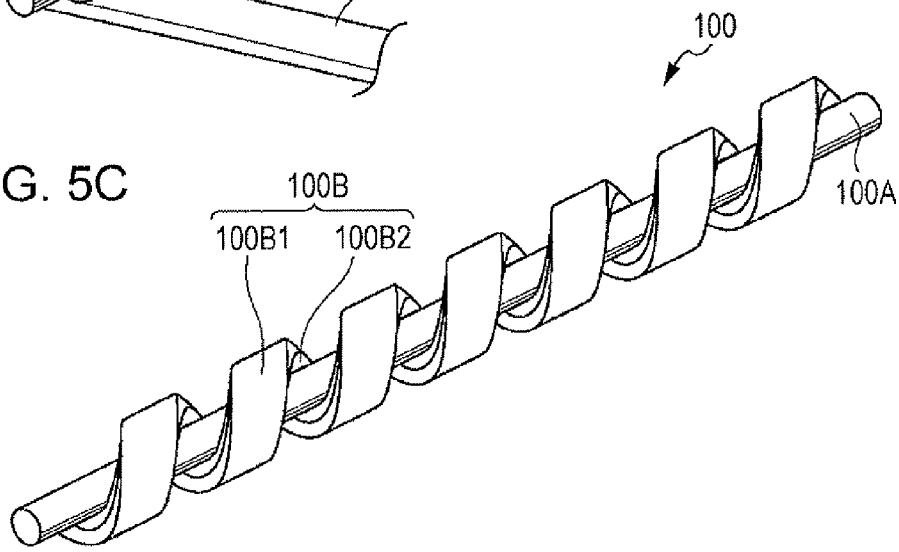

Then, as shown in FIG. 5C, while detaching the releasing paper of the double-sided adhesive tape, the core 100A with the second elastic layer 100B2 thereon is rotated at a target speed to helically wind the strip 100C1 around the peripheral surface of the second elastic layer 100B2 on the core 100A to form the first elastic layer 100B1 helically arranged on the second elastic layer 100B2 on the core 100A.

As a result, a cleaning member 100 including an elastic layer 100B that includes a first elastic layer 100B1 and a second elastic layer 100B2 is obtained.

(Image Forming Apparatus)

An image forming apparatus according to an exemplary embodiment of the present invention will now be described with reference to the drawings.

Figure 6:
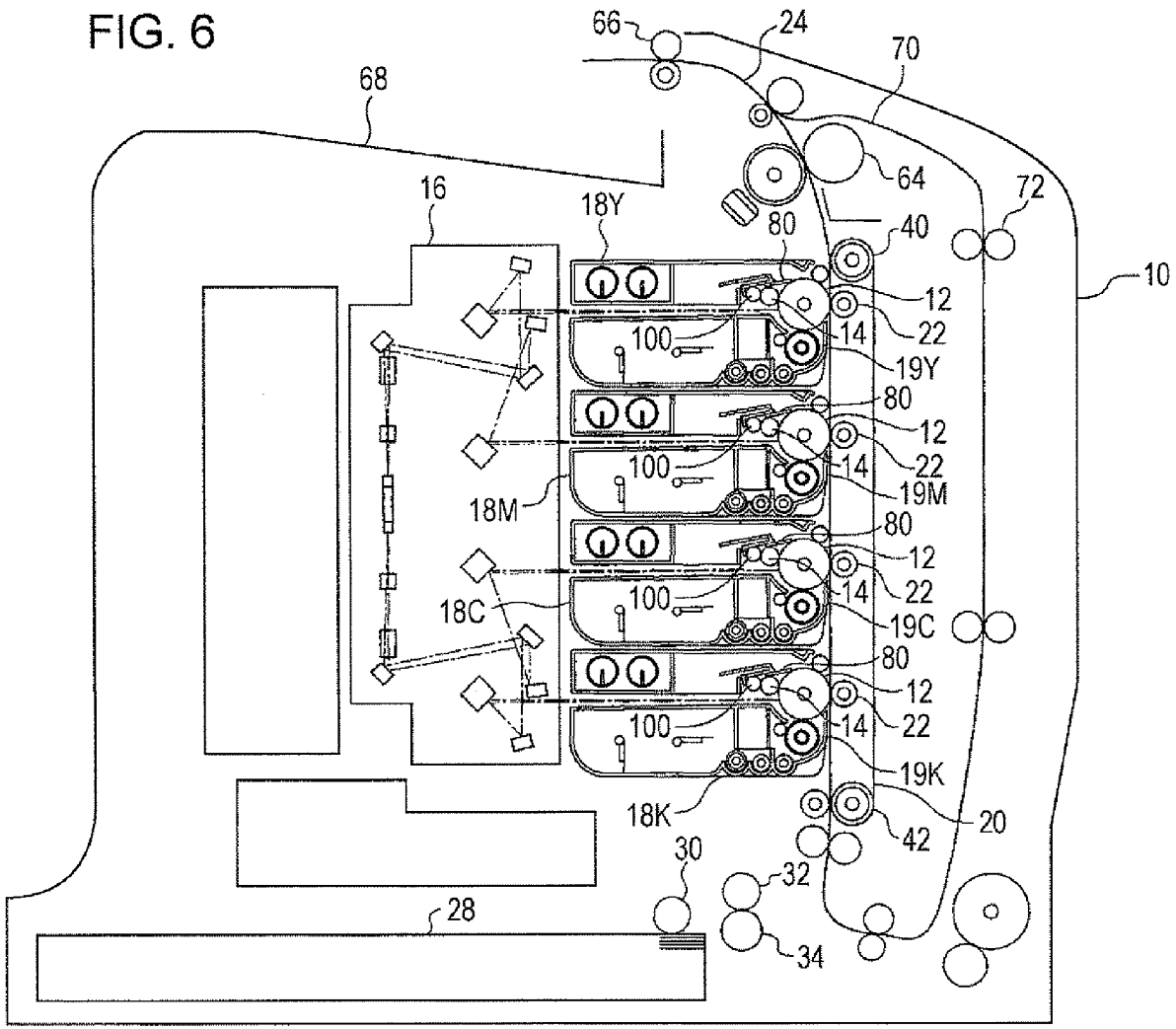
FIG. 6 is a schematic diagram showing an electrophotographic image forming apparatus according to an exemplary embodiment.

FIG. 6 is a schematic diagram showing an image forming apparatus according to an exemplary embodiment.

Figure 7:
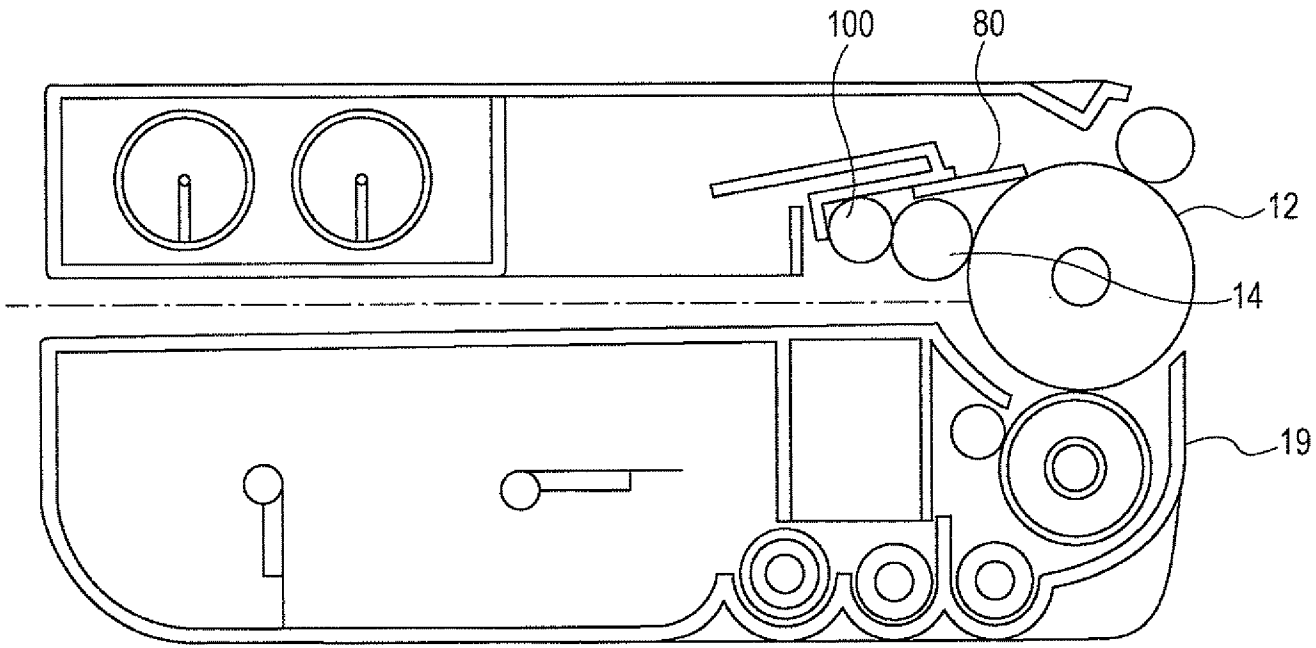
FIG. 7 is a schematic diagram showing a process cartridge according to an exemplary embodiment of the invention.

An image forming apparatus 10 according to the exemplary embodiment is a tandem system color image forming apparatus shown in FIG. 6, for example. Process cartridges (also refer to FIG. 7) each including a photoconductor (image-carrying member) 12, a charging member 14, a developing device 19, and other associated components are arranged inside the image forming apparatus 10. In this exemplary embodiment, four process cartridges 18Y, 18M, 18C, and 18K are respectively provided for four colors, i.e., yellow, magenta, cyan, and black. The process cartridges are detachably mounted to the image forming apparatus 10.

The photoconductor 12 is, for example, a conductive cylindrical body having a diameter of 25 mm and coated with a photoconductor layer composed of an organic photosensitive formed on a surface, and is rotated at a process speed of 150 mm/sec by a motor not shown in the drawing.

The surface of the photoconductor 12 is charged with the charging member 14 put on the surface of the photoconductor 12 and irradiated with a laser beam emitted from an exposure device 16 so as to form an electrostatic latent image, which corresponds to image information, on the downstream side of the charging member 14 in the rotation direction of the photoconductor 12.

The electrostatic latent images formed on the photoconductors 12 are respectively developed with developing devices 19Y, 19M, 19C, and 19K for yellow (Y), magenta (M), cyan (C), and black (K) to form toner images of the four colors.

For example, when a color image is to be formed, the process of charging, exposing, and developing is conducted on the surface of each of the photoconductors 12 corresponding to yellow (Y), magenta (M), cyan (C), and black (K) so as to form a yellow toner image, a magenta toner image, a cyan toner image, and a black toner image on the photoconductors 12, respectively.

The yellow (Y), magenta (M), cyan (C), and black (K) toner images sequentially formed on the photoconductors 12 are transferred onto a recording sheet 24 at positions where the photoconductors 12 contact transfer devices 22 while the recording sheet 24 is transported on an outer peripheral surface of a sheet transport belt 20 given tension by and supported by supporting rolls 40 and 42 from the inner peripheral side. The recording sheet 24 that has received the toner images from the photoconductors 12 is transported to a fixing device 64 and heated and pressured by the fixing device 64 to fix the toner images on the recording sheet 24. The recording sheet 24 with toner images fixed thereon is ejected with an ejection roll 66 onto an ejection unit 68 in the upper part of the image forming apparatus 10 when the printing is to be performed on only one side of the recording sheet 24.

The recording sheet 24 is supplied from a sheet container 28 by using a feed roller 30 and transported with transport rolls 32 and 34 to the sheet transport belt 20.

In the case where double-side printing is to be conducted, the recording sheet 24 with toner images fixed on a first surface (front surface) by the fixing device 64 is not ejected onto the ejection unit 68 by the ejection roll 66. Instead, the ejection roll 66 holding the rear end of the recording sheet 24 is reversed while the transport path of the recording sheet 24 is switched to a sheet transport path 70 for double-side printing. The recording sheet 24 with its side reversed is again transported onto the sheet transport belt 20 by using a transport roll 72 installed on the sheet transport path 70 so as to transfer toner images onto a second surface (rear surface) of the recording sheet 24 from the photoconductors 12. The toner images on the second surface (rear surface) of the recording sheet 24 are fixed with the fixing device 64 and the recording sheet (transfer-receiving member) 24 is ejected onto the ejection unit 68.

The surface of the photoconductor 12 after the toner image transfer step is cleaned with a cleaning blade 80 arranged downstream of the position that has come into contact with the transfer device 22 in the rotation direction of the photoconductor 12. This cleaning is conducted every time the photoconductor 12 is rotated to remove residual toner, paper dust, and the like, and to prepare for the next image formation.

Figure 8:
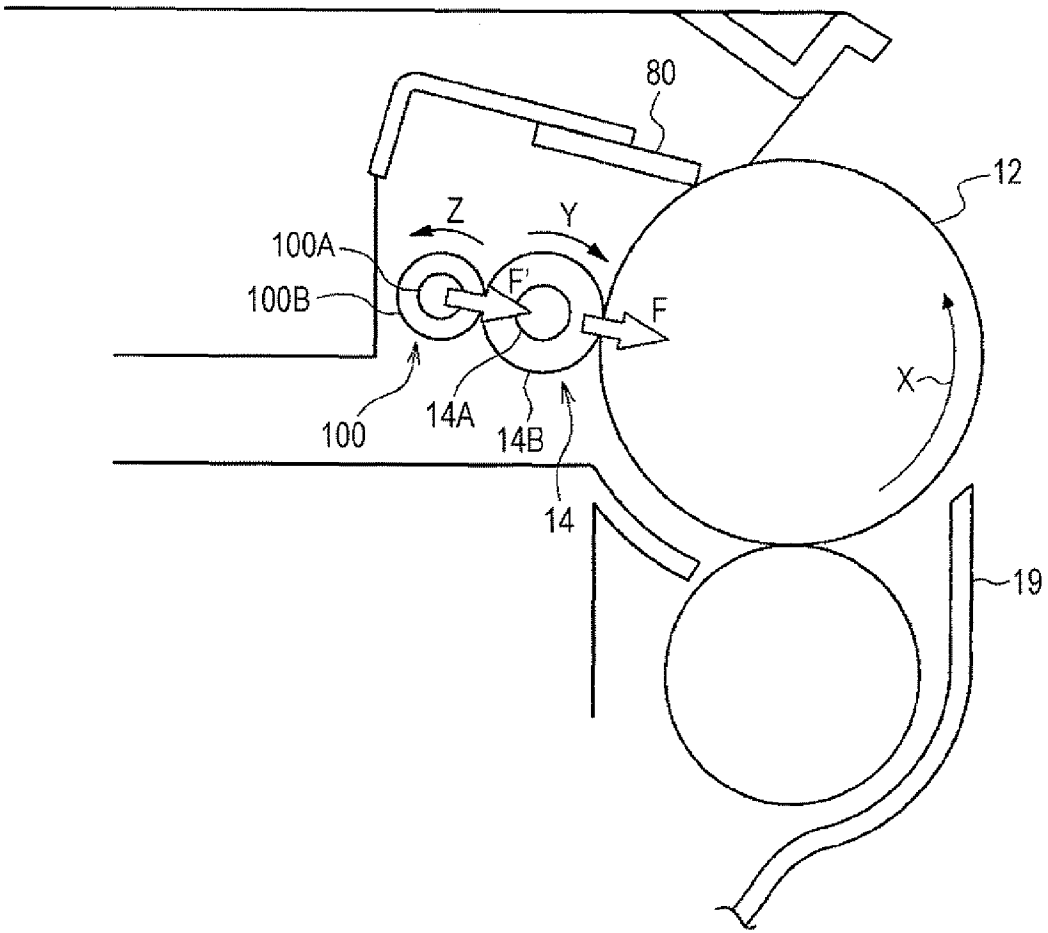
FIG. 8 is an enlarged schematic diagram showing a vicinity of a charging member (charging device) shown in FIGS. 6 and 7.

As shown in FIG. 8, the charging member 14 is, for example, a roll including a rotatably supported conductive core 14A and an elastic layer 14B surrounding the core 14A. A cleaning member 100 for cleaning the charging member 14 is in contact with a side of the charging member 14 remote from the photoconductor 12. The cleaning member 100 is part of a charging unit. The cleaning member 100 of the exemplary embodiment is used as the cleaning member 100.

The description below concerns the case in which the cleaning member 100 is always in contact with the charging member 14 and driven by the charging member 14. Alternatively, the charging member 14 may be brought into contact with and driven by the charging member 14 only during cleaning. Yet alternatively, the cleaning member 100 may be brought into contact with the charging member 14 only during cleaning and driven separately so as to have a peripheral speed different from that of the charging member 14. However, having the cleaning member 100 always in contact with the charging member 14 and creating a difference in peripheral speed may be avoided since contamination on the charging member 14 accumulates on the cleaning member 100 and may re-deposit on the charging member 14.

The charging member 14 is pressed against the photoconductor 12 by application of a load F to both ends of the core 14A so that a nip portion is formed along the peripheral surface of the elastic layer 14B by elastic deformation. The cleaning member 100 is pressed against the charging member 14 by application of a load F' to both ends of the core 100A so that a nip portion is formed along the peripheral surface of the charging member 14 by elastic deformation of the elastic layer 100B. As a result, a nip portion is formed in the axis direction of the charging member 14 and the photoconductor 12 while suppressing the deflection of the charging member 14.

The photoconductor 12 is rotated in the arrow X direction by a motor not shown in the drawing and the charging member 14 is driven in the arrow Y direction by the rotation of the photoconductor 12. The cleaning member 100 is driven by the rotation of the charging member 14 and rotates in the arrow Z direction.

—Structure of Charging Member—

The description of the charging member is given below but the structure of the charging member is not limited by the description.

The structure of the charging member is not particularly limited. For example, the charging member may include a core and an elastic layer or a resin layer instead of the elastic layer. The elastic layer may have a single-layer structure or a multilayer structure including two or more layers having various functions. The elastic layer may be surface-treated.

The material of the core may be free-cutting steel or stainless steel. The material and a surface treatment method may be adequately selected according to the property such as slidability. The core may be plated. When a material having no electrical conductivity is used, the material may be processed by a typical treatment such as plating to impart electrical conductivity or may be directly used as is.

The elastic layer is a conductive elastic layer. For example, the conductive elastic layer may contain, an elastic material such as rubber, a conductive material such as carbon black and an ion conductive material for adjusting the resistance of the conductive elastic layer, and any additives commonly used as needed, such as a softener, a plasticizer, a curing agent, a vulcanizing agent, a vulcanization accelerator, an antioxidant, and a filler such as silica or calcium carbonate. The elastic layer is formed by coating the peripheral surface of the conductive core with a mixture of these materials. Examples of the conductive agent for adjusting the resistance include carbon black blended with a matrix material and a dispersion of a conductive material that uses at least one of electrons and ions as charge carriers, such as an ion conductive material. The elastic material may be foamed.

The elastic material constituting the conductive elastic layer is formed by dispersing a conductive agent in a rubber material. Examples of the rubber material include silicone rubber, ethylene propylene rubber, epichlorohydrin-ethylene oxide copolymer rubber, epichlorohydrin-ethylene oxide-allyl glycidyl ether copolymer rubber, acrylonitrile-butadiene copolymer rubber, and blend rubber of these. These rubber materials may be foamed or unfoamed.

Examples of the conductive agent include electronic conductive agents and ion conductive agents. Examples of the electronic conductive agents include fine particles composed of carbon black such as Ketjenblack and acetylene black; thermal black and graphite; various conductive metals such as aluminum, copper, nickel, and stainless steel and alloys thereof; conductive metal oxides such as tin oxide, indium oxide, titanium oxide, tin oxide-antimony oxide solid solution, and tin oxide-indium oxide solid solution; and insulating materials having surfaces treated to exhibit conductivity. Examples of the ion conductive agent include perchloric acid salts and chlorates such as tetraethylammonium and lauryltrimethylammonium; and perchloric acid salts and chlorates of alkali metals and alkaline earth metals such as lithium and magnesium.

These conductive agents may be used alone or in combination of two or more. The amounts of these conductive agents added are not particularly limited. The amount of the electronic conductive agent may be 1 to 60 parts by mass relative to 100 parts by mass of rubber material. The amount of the ion conductive agent may be 0.1 to 5.0 parts by mass relative to 100 parts by mass of rubber material.

A surface layer may be formed in the surface of the charging member. The material for the surface layer may be resin, rubber, or any other suitable material and is thus not particularly limited. Examples of the material for the surface layer include polyvinylidene fluoride, ethylene tetrafluoride copolymers, polyester, polyimide, and copolymer nylon.

Examples of the copolymer nylon include those that contain at least one of nylon 6,10, nylon 11, and nylon 12 as a polymerization unit. Examples of other polymerization unit contained in the copolymer include nylon 6 and nylon 6,6. The ratio of a polymerization unit constituted by nylon 6,10, nylon 11, and/or nylon 12 in the copolymer may be 10% by mass or more in total.

The polymer materials may be used alone or in combination of two or more. The number-average molecular weight of the polymer material is preferably 1,000 to 100,000 and more preferably 10,000 to 50,000.

A conductive material may be added to the surface layer to control the resistance. A conductive material may have a particle size of 3 μm or less.

Examples of the conductive agent for adjusting the resistance include carbon black and conductive metal oxide particles blended with a matrix material, and a dispersion of a conductive material that uses at least one of electrons and ions as charge carriers, such as an ion conductive material.

Examples of carbon black used as a conductive agent include Special Black 350, Special Black 100, Special Black 250, Special Black 5, Special Black 4, Special Black 4A, Special Black 550, Special Black 6, Color Black FW200, Color Black FW2, and Color Black FW2V produced by Degussa, and MONARCH 1000, MONARCH 1300, MONARCH 1400, MOGUL-L, and REGAL 400R produced by CABOT CORPORATION.

Carbon black may have a pH of 4.0 or less.

The conductive metal oxide particles used as conductive particles for adjusting resistance is not particularly limited and may be any conductive particles that use electrons as charge carriers. Examples thereof include tin oxide, antimony-doped tin oxide, zinc oxide, anatase-type titanium oxide, and indium tin oxide (ITO). These may be used alone or in combination of two or more. The particle size may be any. The conductive particles are preferably tin oxide, antimony-doped tin oxide, or anatase-type titanium oxide and more preferably tin oxide or antimony-doped tin oxide.

The surface layer may be composed of a fluorine-based or silicone-based resin. In particular, the surface layer may be composed of a fluorine-modified acrylate polymer. Particles may be added to the surface layer. Insulating particles such as alumina or silica may be added to impart irregularities on the surface of the charging member so that the frictional load imposed during contact with the photoconductor is decreased and the wear resistance between the charging member and the photoconductor is improved.

The outer diameter of the charging member may be 8 mm to 16 mm. The outer diameter is measured with a commercially available caliper or a laser-system outer diameter measuring device.

The microhardness of the charging member may be 45° to 60°. In order to decrease hardness, the amount of plasticizer added may be increased or a low-hardness material such as silicone rubber may be used.

The microhardness of the charging member may be measured with MD-1 durometer produced by Kobunshi Keiki Co., Ltd.

The image forming apparatus of the exemplary embodiment includes a photoconductor (image-carrying member), a charging device (unit constituted by a charging member and a cleaning member), a developing device, and a cleaning blade (cleaning device) but the image forming apparatus is not limited to this. For example, a charging device (unit constituted by a charging member and a cleaning member) and, if needed, at least one selected from a photoconductor (image-carrying member), an exposing device, a transfer device, a developing device, and a cleaning blade (cleaning device) may be combined to form a process cartridge. It should be noted that these devices and members need not be formed into a cartridge and may be directly installed in the image forming apparatus.

The image forming apparatus of the exemplary embodiment described above includes a charging device which is a unit constituted by a charging member and a cleaning member, in other words, a structure in which the charging member is the member to be cleaned. However, the structure is not limited to this. The member to be cleaning may be a photoconductor (image-carrying member), a transfer device (transfer member or transfer roll), and/or an intermediate transfer member (intermediate transfer belt). The unit constituted by the member to be cleaned and the cleaning member in contact with the member to be cleaned may be installed directly on the image forming apparatus or may be formed into a cartridge as with the process cartridge described above and installed in the image forming apparatus.

The image forming apparatus of the exemplary embodiment is not limited to one having the above-described structure. Image forming apparatuses of an intermediate transfer type and other known types may be employed.

EXAMPLES

The present invention will now be described by using Examples below which do not limit the present invention.

Example 1

(Preparation of Cleaning Roll)

A double-sided adhesive tape 0.2 mm in thickness is attached to urethane foam (BF-150, product of INOAC CORPORATION) 1 mm in thickness and a strip (strip for forming a first elastic layer) 10 mm in width and 360 mm in length is cut out.

A double-sided adhesive tape 0.2 mm in thickness is attached to urethane foam (EP-70, product of INOAC CORPORATION) 1 mm in thickness and a strip (strip for forming a second elastic layer) 10 mm in width and 360 mm in length is cut out.

The strip for forming the second elastic layer is wound around a stepped metal core (outer diameter: 6 mm, length: 337 mm, outer diameter and length of bearing portion: 4 mm and 6 mm, effective length of urethane foam: 320 mm) at a winding angle of 25° while applying tension to stretch the entire length of the strip by about 0 to 5% so as to form a helically arranged second elastic layer.

Next, the strip for forming the first elastic layer is wound around the second elastic layer on the stepped metal core while applying tension to stretch the entire length of the strip by about 0 to 5% so as to form a helically arranged first elastic layer.

Thus, a cleaning roll is obtained.

(Preparation of Charging Roll)

Formation of Elastic Layer

A mixture described below is kneaded with an open roll, applied on a surface of a conductive support composed of SUS 416 stainless steel 6 mm in diameter so as to form a cylindrical body having a thickness of 3 mm, placed in a cylindrical die having an inner diameter of 18.0 mm, vulcanized for 30 minutes at 170° C., released from the die, and polished to obtain a cylindrical conductive elastic layer A.

| | |
|---|---|
| Rubber material: (epichlorohydrin-ethylene oxide-allyl glycidyl ether copolymer rubber) Gechron 3106: product of ZEON CORPORATION | 100 parts by mass |
| Conductive agent (carbon black Asahi Thermal, product of ASAHI CARBON CO., LTD.) | 25 parts by mass |
| Conductive agent (Ketjenblack EC: product of Lion Corporation) | 8 parts by mass |
| Ion conductive agent (lithium perchlorate) | 1 part by mass |
| Vulcanizing agent (sulfur) 200 mesh: product of Tsurumi Chemical Co. | 1 part by mass |
| Vulcanization accelerator (Nocceler DM: product of OUCHI SHINKO CHEMICAL INDUSTRIAL CO., LTD) | 2.0 parts by mass |
| Vulcanization accelerator (Nocceler TT: product of OUCHI SHINKO CHEMICAL INDUSTRIAL CO., LTD) | 0.5 parts by mass |

Formation of Surface Layer

A dispersion obtained by dispersing the mixture below with a bead mill is diluted with methanol, applied on a surface of the conductive elastic layer A by dip-coating, and thermally dried at 140° C. for 15 minutes to form a surface layer having a thickness of 4 μm to obtain a conductive roll. This conductive roll is used as a charging roll.

| | |
|---|---|
| Polymer material (copolymer nylon) Amilan CM8000: product of Toray Industries. Inc. | 100 parts by weight |
| Conductive agent (Antimony-doped tin oxide) SN-100P: product of ISHIHARA SANGYO KAISHA LTD. | 30 parts by mass |
| Solvent (methanol) | 500 parts by mass |
| Solvent (butanol) | 240 parts by mass |

Example 2

(Preparation of Cleaning Roll)

A double-sided adhesive tape 0.2 mm in thickness is attached to urethane foam (EST-3, product of INOAC CORPORATION) 1 mm in thickness and a strip (strip for forming a first elastic layer) 10 mm in width and 360 mm in length is cut out.

A double-sided adhesive tape 0.2 mm in thickness is attached to urethane foam (EP-70, product of INOAC CORPORATION) 1 mm in thickness and a strip (strip for forming a second elastic layer) 10 mm in width and 360 mm in length is cut out.

A cleaning roll is obtained as in Example 1 except that the above-described strip for the first elastic layer and strip for the second elastic layer are used.

(Preparation of Charging Roll)

A charging roll is prepared as in Example 1.

Example 3

(Preparation of Cleaning Roll)

A double-sided adhesive tape 0.2 mm in thickness is attached to urethane foam (BF-150, product of INOAC CORPORATION) 1 mm in thickness and a strip (strip for forming a first elastic layer) 10 mm in width and 360 mm in length is cut out.

A double-sided adhesive tape 0.2 mm in thickness is attached to urethane foam (ESH, product of INOAC CORPORATION) 1 mm in thickness and a strip (strip for forming a second elastic layer) 10 mm in width and 360 mm in length is cut out.

A cleaning roll is obtained as in Example 1 except that the above-described strip for the first elastic layer and strip for the second elastic layer are used.

(Preparation of Charging Roll)

A charging roll is prepared as in Example 1.

Example 4

(Preparation of Cleaning Roll)

A double-sided adhesive tape 0.2 mm in thickness is attached to urethane foam (EST-3, product of INOAC CORPORATION) 1 mm in thickness and a strip (strip for forming a first elastic layer) 10 mm in width and 360 mm in length is cut out.

A double-sided adhesive tape 0.2 mm in thickness is attached to urethane foam (ESH, product of INOAC CORPORATION) 1 mm in thickness and a strip (strip for forming a second elastic layer) 10 mm in width and 360 mm in length is cut out.

A cleaning roll is obtained as in Example 1 except that the above-described strip for the first elastic layer and strip for the second elastic layer are used.

(Preparation of Charging Roll)

A charging roll is prepared as in Example 1.

Example 5

(Preparation of Cleaning Roll)

A double-sided adhesive tape 0.2 mm in thickness is attached to urethane foam (RR-80, product of INOAC CORPORATION) 1 mm in thickness and a strip (strip for forming a first elastic layer) 10 mm in width and 360 mm in length is cut out.

A double-sided adhesive tape 0.2 mm in, thickness is attached to urethane foam (EP-70, product of INOAC CORPORATION) 1 mm in thickness and a strip (strip for forming a second elastic layer) 10 mm in width and 360 mm in length is cut out.

A cleaning roll is obtained as in Example 1 except that the above-described strip for the first elastic layer and strip for the second elastic layer are used.

(Preparation of Charging Roll)

A charging roll is prepared as in Example 1.

Example 6

(Preparation of Cleaning Roll)

A double-sided adhesive tape 0.2 mm in thickness is attached to urethane foam (EST-3, product of INOAC CORPORATION) 1 mm in thickness and a strip (strip for forming a first elastic layer) 10 mm in width and 360 mm in length is cut out.

A double-sided adhesive tape 0.2 mm in thickness is attached to urethane foam (BF-150, product of INOAC CORPORATION) 1 mm in thickness and a strip (strip for forming a first elastic layer) 10 mm in width and 360 mm in length is cut out.

A cleaning roll is obtained as in Example 1 except that the above-described strip for the first elastic layer and strip for the second elastic layer are used.

(Preparation of Charging Roll)

A charging roll is prepared as in Example 1.

Comparative Example 1

(Preparation of Cleaning Roll)

A double-sided adhesive tape 0.2 mm in thickness is attached to urethane foam (EP-70, product of INOAC CORPORATION) 1 mm in thickness and a strip (strip for forming a first elastic layer) 10 mm in width and 360 mm in length is cut out.

A double-sided adhesive tape 0.2 mm in thickness is attached to urethane foam (BF-150, product of INOAC CORPORATION) 1 mm in thickness and a strip (strip for forming a second elastic layer) 10 mm in width and 360 mm in length is cut out.

A cleaning roll is obtained as in Example 1 except that the above-described strip for the first elastic layer and strip for the second elastic layer are used.

(Preparation of Charging Roll)

A charging roll is prepared as in Example 1.

[Evaluation]

The elastic layer compositions of the cleaning rolls of individual examples are presented in Table 1.

The following evaluation is conducted using the cleaning rolls and charging rolls prepared in the examples. The results are shown in Table 1.

(Image Defect after Storage)

A cleaning roll and a charging roll of each example are installed in a process cartridge for a color copier DocuCentre-III C3300 produced by Fuji Xerox Co., Ltd. The process cartridge is left in a 30° C./75% environment for 10 days. Whether image defects caused by deformation of the elastic layer occur or not is identified from half-tone images.

Evaluation Standard for Image Defects Caused by Deformation of the Elastic Layer A: No banding appearing as black streaks occurs in the image.

B: Banding appearing as black streaks occurs in the image but the extent of banding is within the allowable range.

C: Banding appearing as black streaks occurs in the image and the extent of banding is beyond the allowable range.

(Cleaning Property and Color Spots)

A cleaning roll and a charging roll of each example are installed in a color copier DocuCentre-III C3300 produced by Fuji Xerox Co., Ltd.

Print-out is made on 300,000 A4 sheets. The image quality is evaluated by examining the banding (cleaning property) in a half-tone image formed after printing on 300,000 sheets and caused by non-uniform cleaning of the charging roll. Presence of color spots caused by cleaning roll segments is also examined.

Evaluation Standard of Cleaning Property

A: No banding occurs in the image.

B: Slight banding occurs in the image but the extent of banding is within the allowable range.

C: Banding occurs in the image.

Evaluation Standard for Color Spots

A: No color spots occur in the image.

B: Few color spots occur in the image but the extent of color spots is within the allowable range.

C: Color spots occur in the image.

TABLE 1

| | First elastic layer (outermost layer) | | Second elastic layer (lower layer) | | Image defect derived from deformation of | | |
|---|---|---|---|---|---|---|---|
| | Material | Permanent set (%) | Material | Permanent set (%) | elastic layer after storage | Cleaning property | Color spot |
| Example 1 | BF-150 (ether polyurethane not using foam stabilizer) | 10 | EP-70 (ether polyurethane using silicone oil as foam stabilizer | 3 | A | A | A |
| Example 2 | EST-3 (ether polyurethane not using foam stabilizer) | 20 | EP-70 | 3 | B | A | A |
| Example 3 | BF-150 | 10 | ESH (ether polyurethane not using foam stabilizer) | 7 | B | A | A |
| Example 4 | EST-3 | 20 | ESH | 7 | B | A | A |
| Example 5 | RR-80 (ether polyurethane using silicone oil as foam stabilizer) | 7 | EP-70 | 3 | A | A | A |
| Example 6 | EST-3 | 20 | BF-150 | 10 | B | B | B |
| Comparative Example 1 | EP-70 | 3 | BF-150 | 10 | C | B | A |

The results show that, compared to Comparative Example, Examples had less image defects caused by deformation of the elastic layer after storage.

It is also found that Examples exhibited cleaning property and did not suffer from color spots caused by segments of the cleaning roll generated by polishing.

In Examples 1 and 5, the image defects derived from the contamination of the elastic layer by a foam stabilizer after storage are suppressed compared to other Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member for an image forming apparatus, comprising:

a core; and an elastic layer helically put on an outer peripheral surface of the core and including a first elastic layer and a second elastic layer, the first elastic layer being an outermost layer and the second elastic layer being located closer to the core than an first elastic layer and having a compression set smaller than that of the first elastic layer.

2. The cleaning member according to claim 1, wherein the first elastic layer has a compression set of about 5% to about 15%, and the second elastic layer has a compression set less than about 5%.

3. The cleaning member according to claim 1, wherein the elastic layer is composed of a material selected from polyurethane foam, polyethylene foam, polyamide foam, polypropylene foam, silicone rubber, fluorine rubber, urethane rubber, ethylene propylene diene rubber, nitrile butadiene rubber, chloroprene rubber, chlorinated polyisoprene, isoprene, acrylonitrile-butadiene rubber, styrene-butadiene rubber, hydrogenated polybutadiene, and butyl rubber.

4. The cleaning member according to claim 3, wherein the elastic layer is composed of polyurethane foam.

5. The cleaning member according to claim 4, wherein the elastic layer is composed of ether-based polyurethane foam.

6. The cleaning member according to claim 1, wherein the elastic layer is composed of a foam material.

7. The cleaning member according to claim 1, wherein the elastic layer is helically put on the outer peripheral surface of the core at a helical angle of about 10°to about 65°.

8. The cleaning member according to claim 1, wherein a coverage determined by helical width R1 of elastic layer/[helical width R1 of elastic layer+helical pitch R2 of elastic layer (R1+R2)] is about 20% to about 70%.

9. A charging device comprising:

a charging member for charging a member to be charged; and a cleaning member in contact with a surface of the charging member and configured to clean the surface of the charging member, wherein the cleaning member is the cleaning member according to claim 1.

10. The charging device according to claim 9, wherein the first elastic layer has a compression set of about 5% to about 15%, and the second elastic layer has a compression set less than about 5%.

11. The charging device according to claim 9, wherein a coverage determined by helical width R1 of elastic layer/[helical width R1 of elastic layer+helical pitch R2 of elastic layer (R1+R2)] is about 20% to about 70%.

12. A process cartridge comprising:

the charging device according to claim 9, wherein the process cartridge is detachably mounted in an image forming apparatus.

13. The process cartridge according to claim 12, wherein the first elastic layer has a compression set of about 5% to about 15%, and the second elastic layer has a compression set less than about 5%.

14. An image forming apparatus, comprising:

an image-carrying member;

a charging unit including the charging device according to claim 9, the charging unit configured to charge a surface of the image-carrying member;

a latent image-forming unit that forms a latent image on the charged surface of the image-carrying member;

a developing unit that develops the latent image on the image-carrying member with a toner to form a toner image; and a transfer unit for transferring the toner image onto a transfer-receiving member.

15. The image forming apparatus according to claim 14, wherein the first elastic layer has a compression set of about 5% to about 15%, and the second elastic layer has a compression set less than about 5%.

16. The image forming apparatus according to claim 14, wherein a coverage determined by helical width R1 of elastic layer/[helical width R1 of elastic layer+helical pitch R2 of elastic layer (R1+R2)] is about 20% to about 70%.

17. A unit for an image forming apparatus, comprising:

a member to be cleaned; and a cleaning member in contact with a surface of the member to be cleaned and configured to clean the surface of the member to be cleaned, wherein the cleaning member is the cleaning member according to claim 1.

18. A process cartridge comprising:

the unit according to claim 17, wherein the process cartridge is detachably mounted in an image forming apparatus.

19. An image forming apparatus comprising:

the unit according to claim 17.

* * * * *